US006328434B1

(12) United States Patent
Soneda et al.

(10) Patent No.: US 6,328,434 B1
(45) Date of Patent: Dec. 11, 2001

(54) INKJET HEAD, ITS MANUFACTURING METHOD AND RECORDING DEVICE

(75) Inventors: Hiromitsu Soneda; Masayuki Sasaki; Kouichi Sanpei; Mutsuo Watanabe, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/547,739

(22) Filed: Apr. 11, 2000

(30) Foreign Application Priority Data

Jul. 1, 1999 (JP) ..... 11-188078

(51) Int. Cl.[7] ..... B41J 2/045; B41J 2/05
(52) U.S. Cl. ..... 347/68; 347/67; 347/71
(58) Field of Search ..... 347/71, 68, 67; 29/890.1

(56) References Cited

U.S. PATENT DOCUMENTS 4,358,776 * 11/1982 Mitsui ..... 347/220
5,017,941 * 5/1991 Drake ..... 347/67

FOREIGN PATENT DOCUMENTS 3-258551 11/1991 (JP) .
7-285223 10/1995 (JP) .
8-258258 10/1996 (JP) .
9-174838 7/1997 (JP) .
9-174861 7/1997 (JP) .

* cited by examiner

*Primary Examiner*—Thinh Nguyen
(74) *Attorney, Agent, or Firm*—Armstrong, Westerman, Hattori, McLeland & Naughton, LLP

(57) ABSTRACT

It is an exemplified object of the present invention to provide an inkjet head, its manufacturing method, and a recording device that can form a high-quality image while preventing an ink leakage. To accomplish the object, an indent is provided at a joint surface of a pressure chamber plate with an adhesive.

12 Claims, 11 Drawing Sheets

INKJET HEAD, ITS MANUFACTURING METHOD AND RECORDING DEVICE

BACKGROUND OF THE INVENTION

The present invention relates generally to recording devices, and more particularly to a print head (or an inkjet head) for use with an inkjet printer. In a generic sense, the inkjet printer means a nonimpact printer (i.e.,a printer using no ink ribbon) that prints by jetting ink droplets on printing paper from a nozzle of the inkjet head. The present invention, which is fit for a piezo-type or bubble-type inkjet head, is applicable not only to a single printer unit but also widely to copiers, facsimile units, computer systems, word processors, and combination machines thereof which have a printing function. The piezo-type inkjet head has a mechanism extruding ink by using a piezoelectric element, while the bubble-type inkjet head has a mechanism extruding ink by applying heat.

The inkjet printer attracts increasing attention in recent years by the recent growing demand for recording devices that is capable of not only forming a high-quality image at a high speed but also handling multicolor printing. Among inkjet heads, for instance, those which employ a piezoelectric element have increasingly come into the limelight in recent years due to its excellency in energy efficiency. This type of inkjet head is typically given its structure by joining a pressure chamber plate, a thin film, and a piezoelectric element together in this sequence with an adhesive into a three-layer body, to which a nozzle plate having a nozzle hole is joined. In the pressure chamber plate, a plurality of pressure chambers, ink supply channels corresponding thereto, and a common ink chamber are formed by grooving such a rigid member as glass. The nozzle plate is joined to the three-layer body so that each nozzle hole may be arranged around the midsection of each opening of the corresponding pressure chamber.

The piezoelectric element, which includes an internal electrode and an external electrode, deforms into such a shape as to pressurize the pressure chamber through the thin film when a voltage is applied from the external electrode to the internal electrode, i.e., the piezoelectric element is charged, while restoring the original state when the voltage is eliminated, i.e., the piezoelectric element is discharged. The thin film transmits the deformation of the piezoelectric element to the pressure chamber. Thus, when a voltage is applied from the external electrode to the internal electrode, the piezoelectric element deforms and pressurizes the pressure chamber through the thin film, and ink is thereby ejected from the pressure chamber through the nozzle hole. In order to narrow a pitch between adjacent nozzle holes to form high-resolution images, assignee of this application has already proposed some inkjet heads having a layered structure and using a piezoelectric element divided into a plurality of blocks by grooves.

The foregoing inkjet heads having a layered structure normally form a comparatively thick thermosetting adhesive layer on the thin film. This adhesive layer and the pressure chamber plate are pressurized and heated to cure the adhesive, whereby the thin film is joined to the pressure chamber plate. The comparatively thick adhesive layer not only joins securely the thin film and the pressure chamber together, but prevents an ink leakage out of the pressure chamber, the ink supply channel, and the common ink chamber. In addition, the comparatively thick layer prevents a short circuit caused by contaminations from the head and/or leaked ink penetrating the piezoelectric element.

The bonding method like this, however, may disadvantageously lead to draining of the adhesive into the pressure chamber and/or the ink supply channel upon joining the thin film and the pressure chamber plate together, since the adhesive layer is relatively thick. Such adhesive would reduce the volumes of the pressure chambers and the ink supply channels, and, in some instances, clog up the ink supply channel to block the ink supply to the pressure chamber. In addition, the adhesives drains into and unevenly expands in a plurality of the pressure chambers and/or the ink supply channels, causing the uneven thickness of the adhesive layer. Accordingly, the pressure chamber plate would become too inclined to arrange nozzle holes around the midsection of each opening of the corresponding pressure chamber. This would resultantly vary the ink quantity and the internal pressure value among the pressure chambers, and the inkjet properties (e.g., a quantity and speed of a droplet) would vary among the nozzles, entailing a disadvantage in hardly obtaining a high-quality image.

On the other hand, it is conceivable that the thickness of the adhesive layer between the thin film and the pressure chamber plate is made thin, but this would impair the capability of sufficiently preventing the ink leakage from the pressure chamber, etc.; therefore the method of using a considerably reduced amount of adhesives would not be practicable.

BRIEF SUMMARY OF THE INVENTION

Accordingly, it is an exemplified general object of the present invention to provide a novel and useful inkjet head, its manufacturing method, and recording device in which the above disadvantages are eliminated.

Another exemplified and more specific object of the present invention is to provide an inkjet head, its manufacturing method, and a recording device that may form a high-quality image while preventing an ink leakage.

In order to achieve the above objects, an inkjet head as an exemplified embodiment of the present invention comprises a pressure chamber plate which including a pressure chamber which stores ink, an elastic element connected with the pressure chamber plate, a piezoelectric element that may pressurize the pressure chamber in the pressure chamber plate through the elastic element, and an adhesive that adheres the elastic element and the pressure chamber plate to each other, wherein the pressure chamber plate includes an indent as a relief for the adhesive. According to this inkjet head, the adhesive can retreat into the pressure chamber plate when adhering the elastic element to the pressure chamber plate.

An inkjet head as another exemplified embodiment of the present invention comprises a pressure chamber plate including a pressure chamber which stores ink, an auxiliary element connected with the pressure chamber plate, a pressurizing element that may jet the ink in the pressure chamber by pressurizing the pressure chamber, and an adhesive that adheres the auxiliary element and the pressure chamber plate to each other, wherein the pressure chamber plate includes an indent as a relief for the adhesive.

The inkjet head according to this embodiment also provides such an adhesive that can retreat into the indent provided in the pressure chamber plate when adhering the elastic element to the pressure chamber plate. This inkjet head can be applied widely to various types of inkjet heads including piezo and bubble types.

A recording device as an exemplified embodiment of the present invention comprises an inkjet head, and a driving device that drives the inkjet head, wherein the inkjet head comprises a pressure chamber plate including a pressure chamber which stores ink, an auxiliary element connected with the pressure chamber plate, a pressurizing element that may jet the ink in the pressure chamber by pressurizing the pressure chamber, and an adhesive that adheres the auxiliary element and the pressure chamber plate to each other, wherein the pressure chamber plate includes an indent as a relief for the adhesive. This recording device has the same effect as the inkjet head described above.

A manufacturing method of an inkjet head as an exemplified embodiment of the present invention comprises the steps of forming an indent in a pressure chamber plate that includes a pressure chamber that may store ink, connecting an elastic element with the pressure chamber plate via an adhesive while permitting the adhesive to drain into the indent, and connecting with the elastic element a piezoelectric element that can pressurize the pressure chamber in the pressure chamber plate through the elastic element. The instant method may manufacture the above inkjet head.

Other objects and further features of the present invention will become readily apparent from the following description of the embodiments with reference to accompanying drawings.

DETAILED DESCRIPTION OF THE INVENTION

A description will now be given of inkjet head 100 and its manufacturing method as an exemplified embodiment of the present invention with reference to the accompanying drawings. Those elements in each drawing that are designated by the same reference numbers denote the same elements, and a duplicate description thereof will be omitted. Those elements, which are designated by the same reference number with a uppercase or lowercase alphabetical letter attached thereto, indicate variations of the corresponding elements, and, unless otherwise specified, the reference number without any alphabetical letter comprehensively designate all the variations of the corresponding elements.

Figure 1:
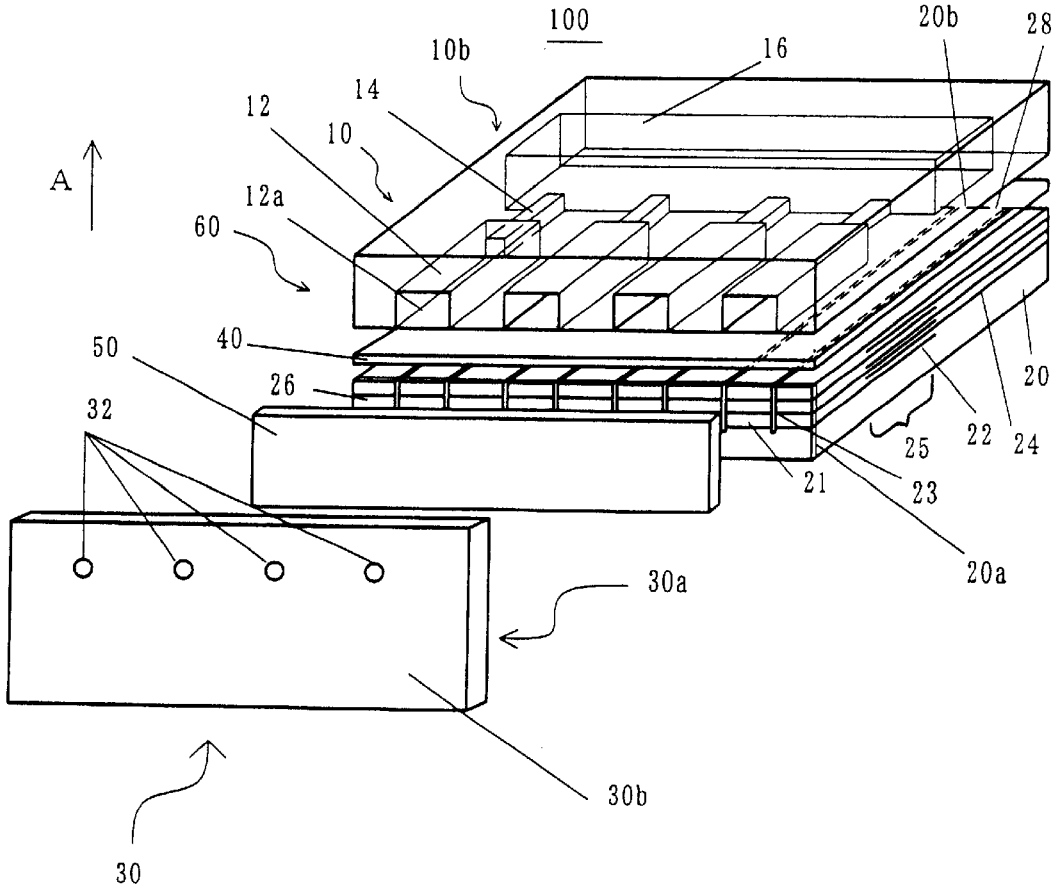
FIG. 1 is a schematic exploded perspective view of an inkjet head as an exemplified embodiment of the present invention.

Referring now to FIG. 1, the inkjet head 100 comprises a pressure chamber plate 10, a piezoelectric element 20, a nozzle plate 30, a resin film 40, and a protective layer 50. FIG. 1 is an exploded perspective view of the inkjet head 100. The pressure chamber plate 10, the resin film 40, and the protective layer 50 are aligned on a nozzle joint surface 60, to which the nozzle plate 30 is joined at a surface 30*a*.

The pressure chamber plate 10 has an approximately parallelepiped shape, and includes the desired number (four in FIG. 1 for description purposes) of pressure chambers 12 and ink supply channels 14, and a common ink chamber 16. The pressure chamber plate 10 may be made of plastic, photosensitive glass, or metal materials. As will be explained later, the pressure chamber plate 10 has indents 18 formed on a bottom surface l0*c*. The pressure chamber plate 10 is joined to (an adhesive layer 70 formed on) the resin film 40 at its bottom surface 10*c*.

Each pressure chamber 12, which is supplied with and contains ink, jets the ink from a corresponding nozzle hole 32 connected to an opening 12*a* as the internal pressure increases. Its internal pressure changes as a piezoelectric block 21 immediately below the pressure chamber 12 deforms, as will be described later. Each pressure chamber 12 is formed as an approximately rectangular parallelepiped space by a concave groove in the pressure chamber plate 10 and the elastically deformable resin film 40.

The common ink chamber 16 supplies ink to each pressure chamber 12 through the corresponding ink supply channel 14. The common ink chamber 16 is defined at the bottom surface with the resin film 40 so as to absorb sudden internal pressure changes in the pressure chamber 12, and connected with an ink supply device (not shown) at a side surface 10*b* of the pressure chamber plate 10. The common ink chamber 16 supplies a necessary amount of ink to each pressure chamber 12 via the ink supply channel 14 while the pressure chamber 12 is returning to the original state after the pressure chamber 12 is pressurized to contract and jet ink. It may be understood that maintaining a cross sectional area of the ink supply channel 14 is significant for a stable ink supply because the ink supply channel 14 is smaller in size than the pressure chamber 12 or the common ink chamber 16 as shown in FIG. 1.

The resin film or oscillatory plate 40, which defines one surface of each pressure chamber 12, common ink chamber 16 and the supply channel 14, serves to transmit a deformation of each piezoelectric block 21, which will be described later, to the pressure chamber 12, and to prevent ink in the pressure chambers 12 from penetrating into the grooves 23 in the piezoelectric element 20. The resin film 40 may be about 16 μm in thickness, for example, and constituted of a single layer or a plurality of layers. The resin film 40, which is a member that forms one surface of each pressure chamber 12, may be replaced with an elastically deformable metal thin film. On the resin film 40 are formed adhesive layers 70 and 72 as will be described later.

The piezoelectric element 20 has a layered structure having a plurality of (four in FIG. 1 for description purposes) piezoelectric blocks 21 which are divided by the parallel grooves 23 that extends from the front surface 20*a* to the back surface 20*b*. Between layers in each piezoelectric block 21 are provided internal electrodes 22 and 24; the internal electrodes 22 are connected to an external electrode 26, and the internal electrodes 24 to an external electrode 28. FIG. 1 shows only one external electrode 28 for illustration purposes. A portion where the internal electrodes 22 and 24 overlap each other in direction A is an active area 25, in which each piezoelectric block 21 deforms. The length of each active area 25 may be adjusted for the pressure to be applied to the pressure chamber 12.

The external electrode 26 is an electrode layer that is formed on an entire surface of a front surface 20*a* of the piezoelectric element 20 by a vacuum evaporation. The external electrode 26 is an electrode commonly used for all the piezoelectric blocks 21. The external electrode 26 is grounded. On the other hand, the external electrode 28 is provided on a rear surface 20*b* of the piezoelectric element 20, but is not formed on an entire surface of the rear surface 20*b*. It is an electrode layer that is independently formed only on an area corresponding to each piezoelectric block 21. The external electrode 28 has the potential of zero unless electrified, but may apply a positive voltage to the internal electrode 24 if electrified.

Due to such a structure, each piezoelectric block 21 in the piezoelectric element 20 does not deform when no voltage is applied to the external electrode 28, since potentials of the internal electrodes 22 and 24 both remain zero. However, when the voltage is applied from the external electrode 28, each piezoelectric block 21 may possibly deform in the direction A (longitudinal direction) in FIG. 1, independently of each other. In other words, the direction A is the polarization direction for the piezoelectric blocks 21. If the electrification from the external electrode 28 stops, that is, if the piezoelectric element 20 is discharged, then the corresponding piezoelectric block 21 returns to the original state.

Figure 2:
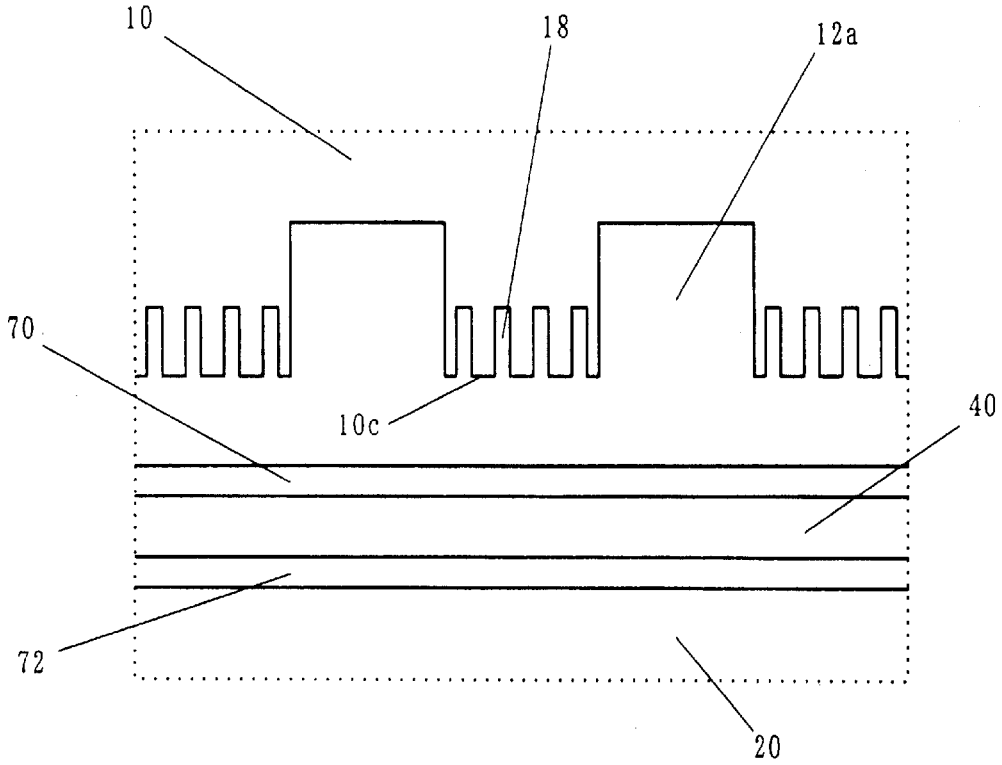
FIG. 2 is an exemplified partially enlarged sectional view of a pressure chamber plate and a resin film of the inkjet head shown in FIG. 1 before they are joined together.
Figure 3:
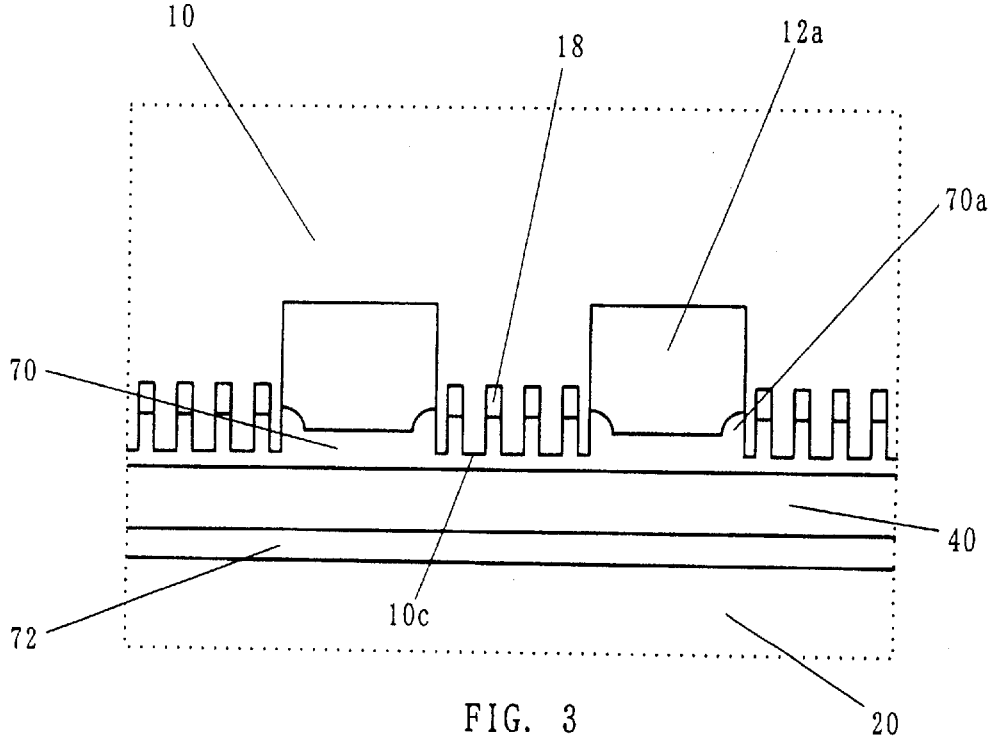
FIG. 3 is an exemplified partially enlarged sectional view of a pressure chamber plate and a resin film as shown in FIG. 2 after joined together.
Figure 4:
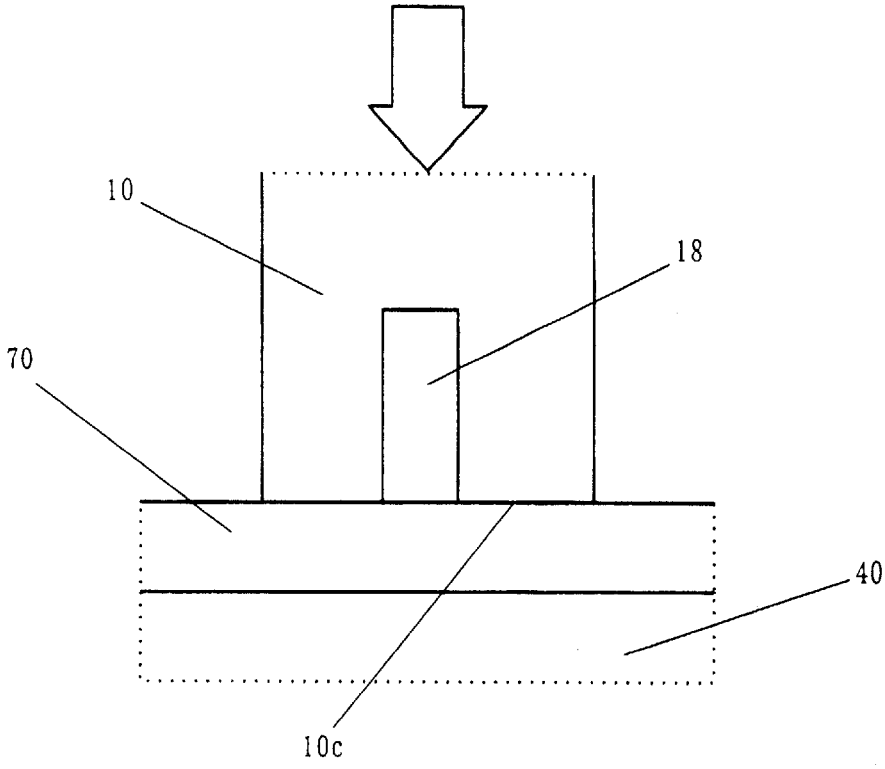
FIG. 4 is an exemplified partially enlarged sectional view of the pressure chamber plate and the resin film shown in FIG. 2.
Figure 5:
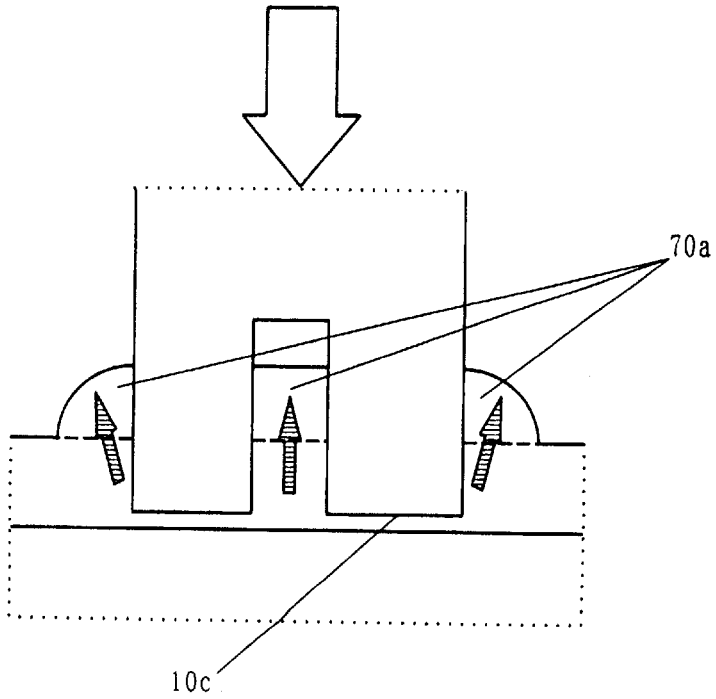
FIG. 5 is an exemplified partially enlarged sectional view of the pressure chamber plate and the resin film shown in FIG. 3.

Referring next to FIGS. 2 through 5, a description will be given of adhesion between the pressure chamber plate 10 and the resin film 40 in the inkjet head 100 of the present invention. FIG. 2 is a partially enlarged sectional view of the pressure chamber plate and the resin film before they are adhered to each other, and FIG. 3 is a partially enlarged sectional view of them after they are adhered to each other. FIG. 4 is a partially enlarged sectional view of the pressure chamber plate and the resin film shown in FIG. 2, and FIG. 5 is a partially enlarged sectional view of the pressure chamber plate and the resin film shown in FIG. 3.

As FIGS. 2 and 3 show their enlarged view, the resin film 40 and the piezoelectric element 20 are adhered to each other via the adhesive layer 72, and the pressure chamber plate 10 and the resin film 40 are adhered to each other via the adhesive layer 70. As the adhesive layers (adhesives) 70 and 72 urethane thermosetting adhesive (shaped like a film) made by Panac Corp. may be used, for example. Attention will now be focused on the adhesive layer 70, which is about 3 μm in thickness before the pressure chamber plate 10 and the resin film 40 are adhered to each other (i.e., in a state shown in FIGS. 2 and 4).

As shown in FIGS. 2 through 5, the pressure chamber plate 10 has a plurality of concave indents or grooves 18 in the bottom surface 10*c*, though the form of the indents 18 is not limited to such a concave shape, but a plurality of indents 18 may also be embodied by taking a variety of sizes, shapes, pitches adjacent to each other, and the likes. It may be readily understood that arrangement of the pressure chamber plate 10 and the resin film 40 as shown in FIGS. 2 and 4 and the subsequent application of a pressure to them as shown in FIGS. 3 and 5 would cause the adhesives 70 to drain into grooves 18, and to reduce overflows 70*a* in the openings 12*a* compared with an inkjet head having no indent 18. Moreover, the adhesive layer 70 after adhesion has, for example, a thickness of 2 μm as shown in FIGS. 3 and 5; therefore the adhesive layer 70 having such thickness can effectively prevent ink from leaking out of the pressure chambers 12, the ink supply channels 14, and the common ink chamber 16, and steadfastly join respective elements together, thereby providing a stable structure of the inkjet head 100.

Figure 6:
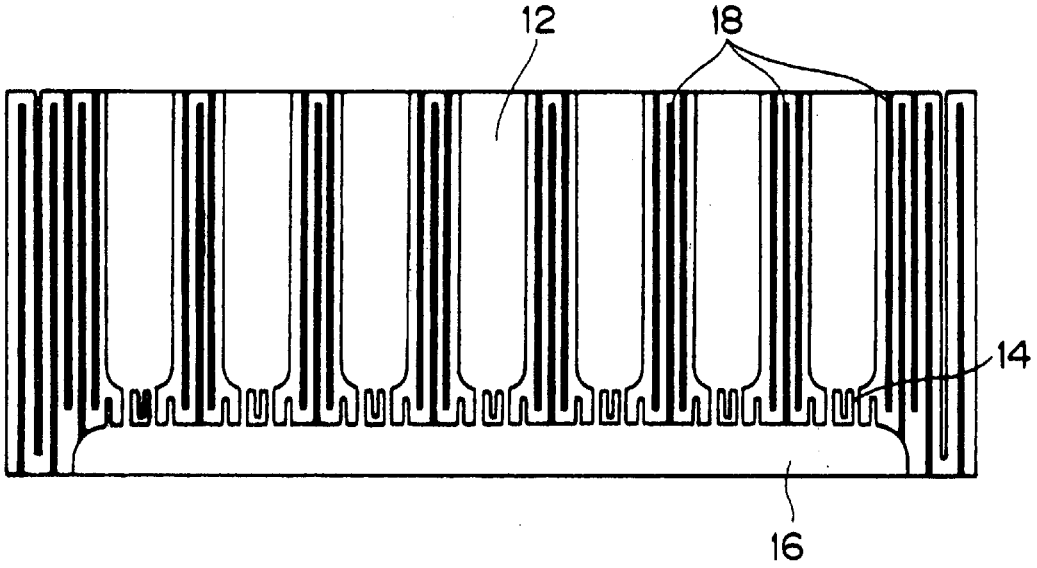
FIG. 6 is an exemplified plane view of the bottom of a pressure chamber plate having indents.
Figure 7:
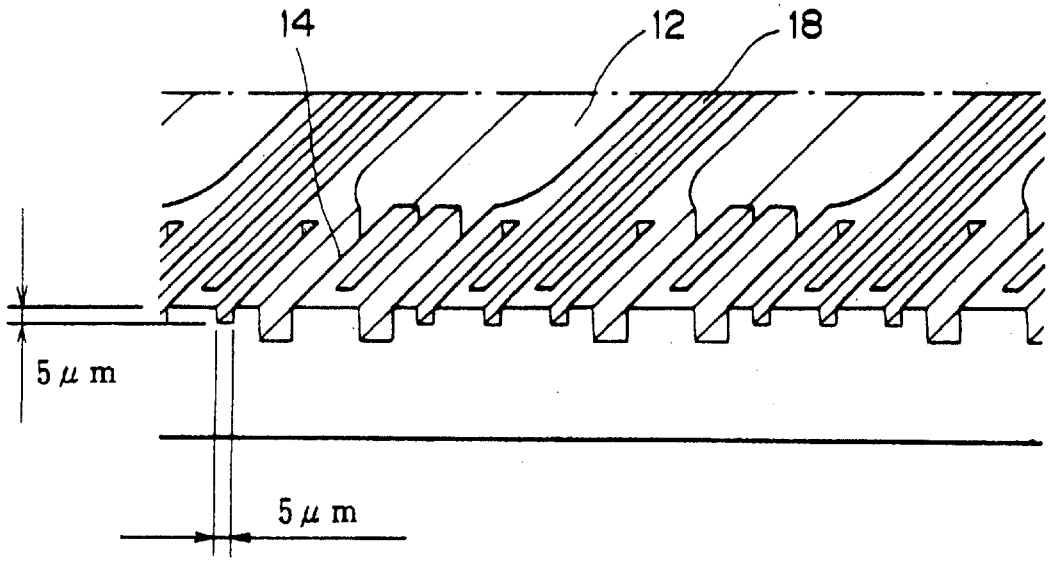
FIG. 7 is a partially enlarged perspective view of the pressure chamber plate in FIG. 6 with the bottom turned up.
Figure 8:
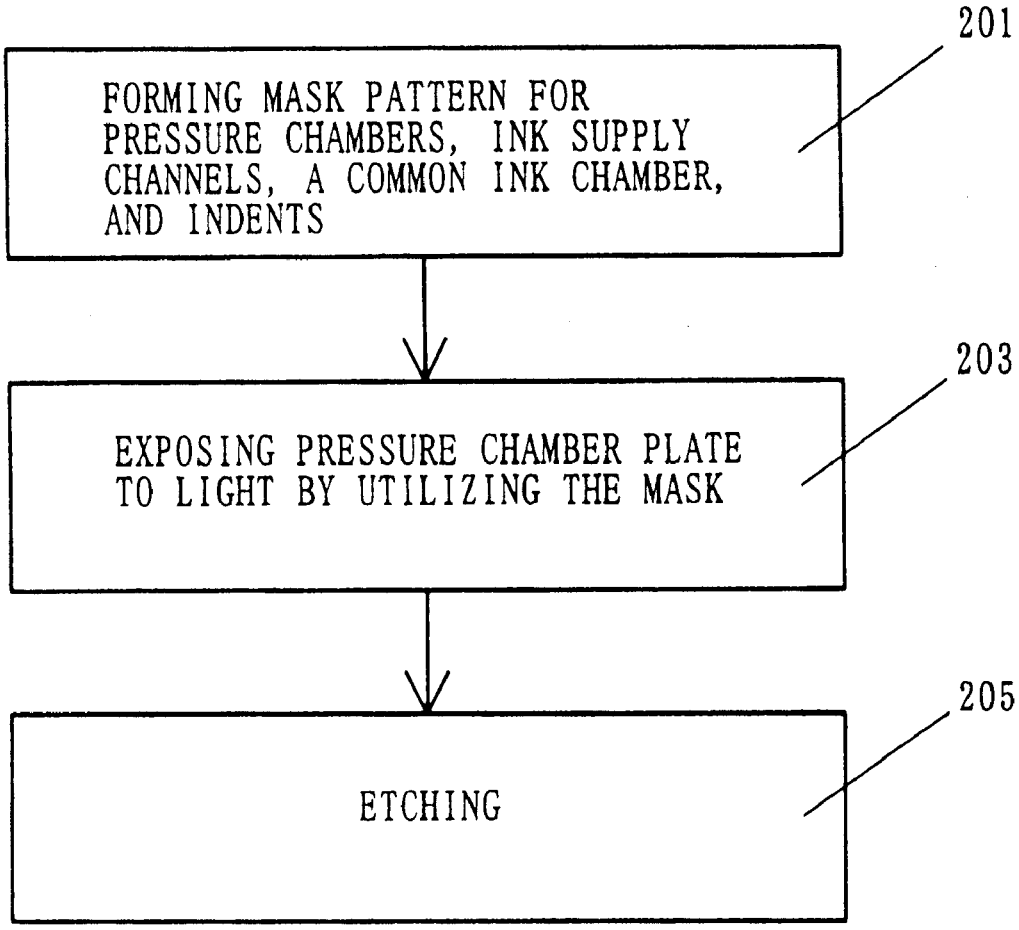
FIG. 8 is a flowchart for an exemplified method of manufacturing the pressure chamber plate shown in FIGS. 6 and 7.

Next, a description will be given of a method of manufacturing the pressure chamber plate 10 of the inkjet head 100 shown in FIG. 1 as an exemplified embodiment with reference to FIGS. 6 to 8 inclusive. FIG. 6 is a plane view of the pressure chamber plate 10 having indents 18 viewed from its bottom surface 10*c*. FIG. 7 is a partially enlarged perspective view of the pressure chamber plate 10 shown in FIG. 6 with the bottom surface 10*c* turned up. FIG. 8 is a flowchart for an exemplified method of manufacturing the pressure chamber plate 10 shown in FIGS. 6 and 7.

In the present embodiment, the pressure chamber plate 10 is made of photosensitive glass, for example, and a patterned mask for the pressure chambers 12, the ink supply channels 14, the common ink chamber 16, and the indents 18 is created by using well-known photolithographic techniques (step 201). In this embodiment, a plurality of indents 18 shaped like a stripe of 5 μm in width, 5 μm in depth, and 10 μm in pitch are arranged parallel to the longitudinal direction of the pressure chambers 12. Each indent 18 is formed in such a position as spaced from at least one of the adjacent pressure chamber 12 and ink supply channel 14, and this is for the following reasons. Since the indents 18 are not always filled with the adhesives 70, if adjacent pressure chambers 12 would be connected via the indent 18, then an internal pressure of one of the pressure chambers 12 would be transmitted to its adjacent pressure chamber 12, causing ink to unintentionally jet out from the adjacent pressure chamber 12, or lowering the internal pressure of the pressure chamber 12 to be pressurized whereby a quantity or speed of ink droplets to be ejected would change.

Subsequently, the bottom surface 10*a* of the pressure chamber plate 10 is exposed to light by using the above mask (step 203). Then, the pressure chamber plate 10 is etched (step 205), and the pressure chamber plate 10 shown in FIG. 6 is completed. As necessary apparatuses and methods for etching, such as controlling the etching depth and length, can be selected from those known in the art, a detailed description thereof will be omitted. Particularly, the indents 18 of the present embodiment maintain the cross-sectional areas of the ink supply channels 14 that are smaller than those of the pressure chambers 12, thereby providing a stable ink supply to the pressure chambers. Needless to say, as the indents 18 maintain the cross-sectional areas of the pressure chambers 12, the ink quantity in the pressure chambers 12 does not decrease significantly. In addition, the indents 18 maintain the flatness of the pressure chamber plate 10 when it is set up. Thus, the indents 18 allow each nozzle hole 32 to be placed around the midsection in the opening 12*a* of the pressure chamber 12, and ink droplets to be stably discharged from the nozzle hole 32. In particular, it may be understood that the indents 18 serve to simply and inexpensively prevent a crosswalk or interference between nozzles in the inkjet head in which is being increasingly demanded to narrow adjacent nozzle pitch.

It goes without saying that method of forming the indents 18 is not limited to the etching as discussed above. To form the indents 18, various approaches may be taken, including drenching the bottom surface 10*c* in a chemical solution, electroforming and/or precision-machining, and pouring a material of the pressure chamber plate 10 into a mold that previously includes the pressure chambers 12, the ink supply channels 14, the common ink chamber 16, and the indents 18. Referring now to FIGS. 9 through 14, a description will be given of a method of forming indents 8A by grinding the bottom surface 10*c* in the pressure chamber plate 10.

Figure 9:
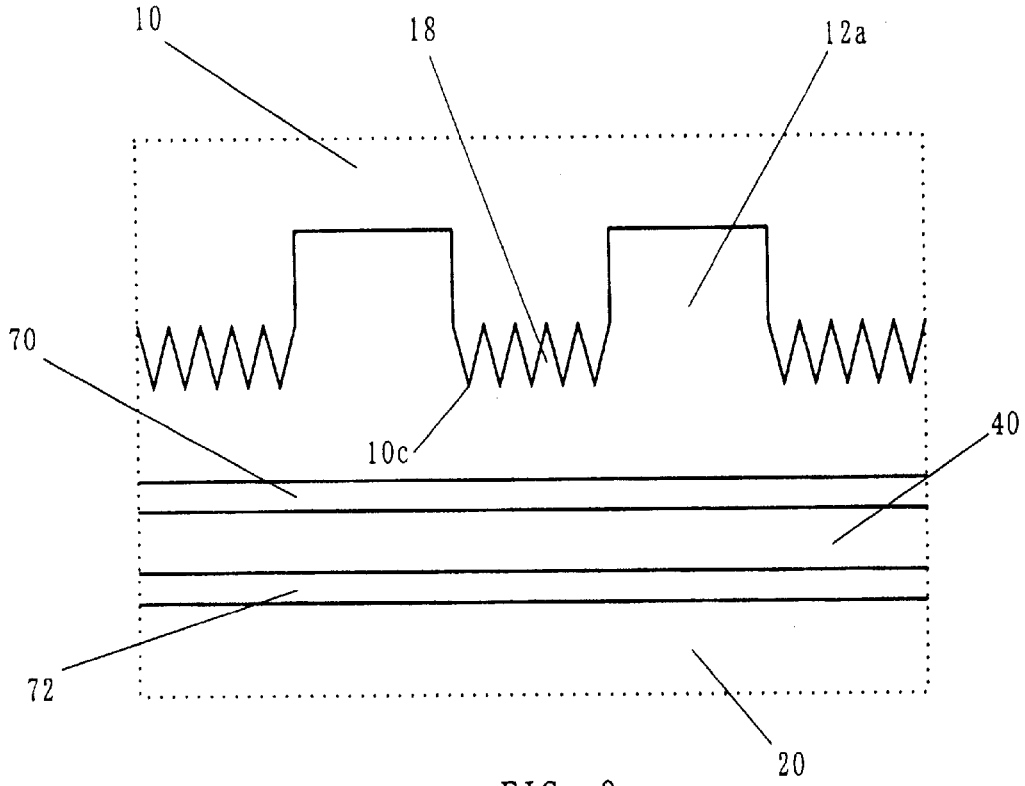
FIG. 9 is another exemplified partially enlarged sectional view of a pressure chamber plate and a resin film of the inkjet head shown in FIG. 1 before they are joined together.
Figure 10:
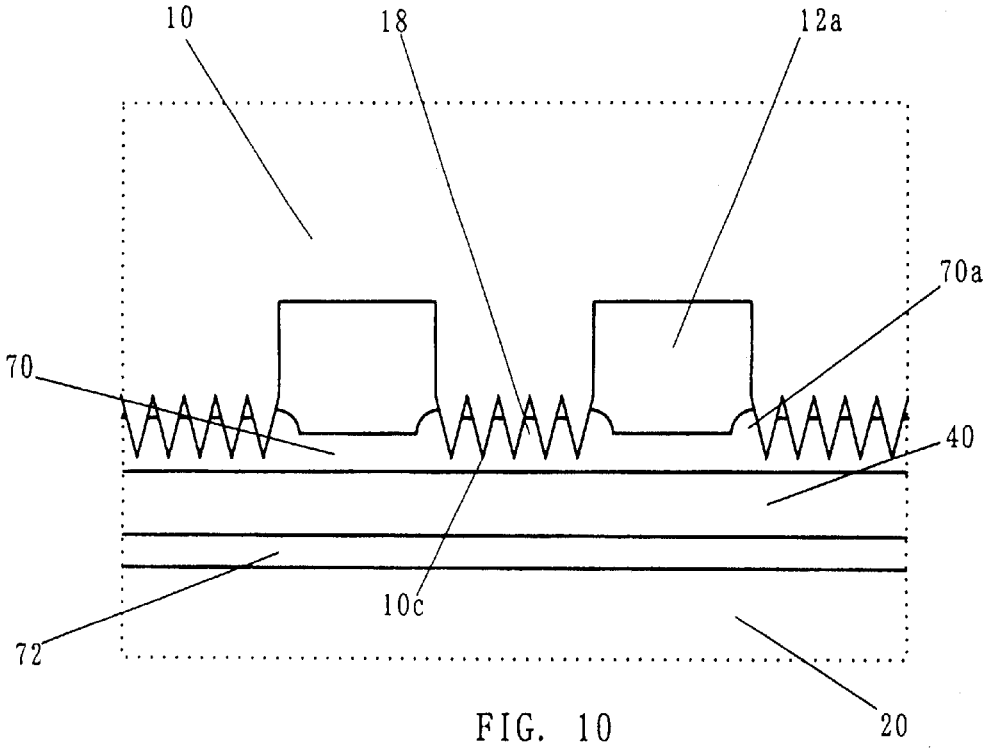
FIG. 10 is a partially enlarged sectional view of the pressure chamber plate and the resin film shown in FIG. 9 after they are joined together.

FIGS. 9 and 10 are partially enlarged sectional views of the adhesive portion of the pressure chamber plate 10 having the abraded bottom surface 10*c* and the resin film 40; FIG. 9 shows a pre-adhesion state, and FIG. 10 shows a post-adhesion state. As shown in FIG. 9, the pressure chamber plate 10 has the indents 18A on the bottom surface 1O*c* by abrasion. It may be understood from the illustration in FIG. 10 that joining the pressure chamber plate 10 and the resin film 40 would cause the adhesives 70*a* to drain into the grooves 18, and reduce the overflows 70*a* in the openings 12*a* compared with an inkjet head having no indent 18A.

Figure 11:
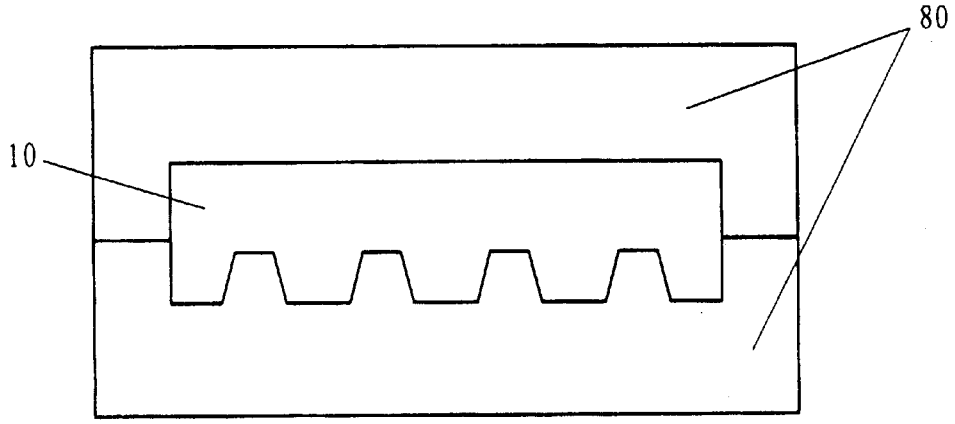
FIG. 11 is a sectional view for explaining a step of an exemplified method of manufacturing the pressure chamber plate shown in FIGS. 9 and 10.
Figure 12:
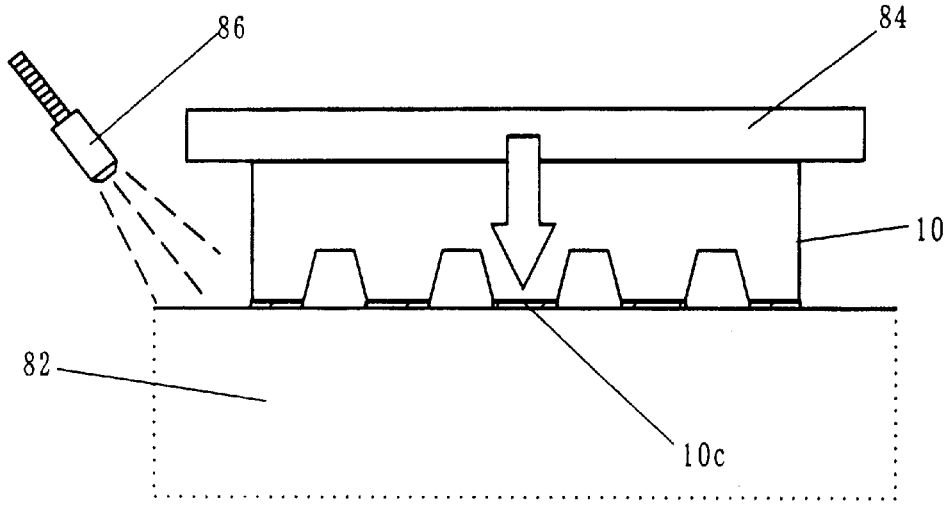
FIG. 12 is a sectional view for explaining another step of an exemplified method of manufacturing the pressure chamber plate shown in FIGS. 9 and 10.
Figure 13:
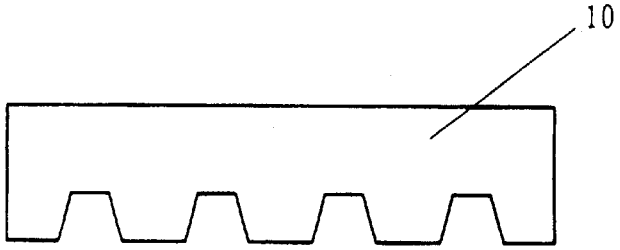
FIG. 13 is a sectional view for explaining still another step of an exemplified method of manufacturing the pressure chamber plate shown in FIGS. 9 and 10.
Figure 14:
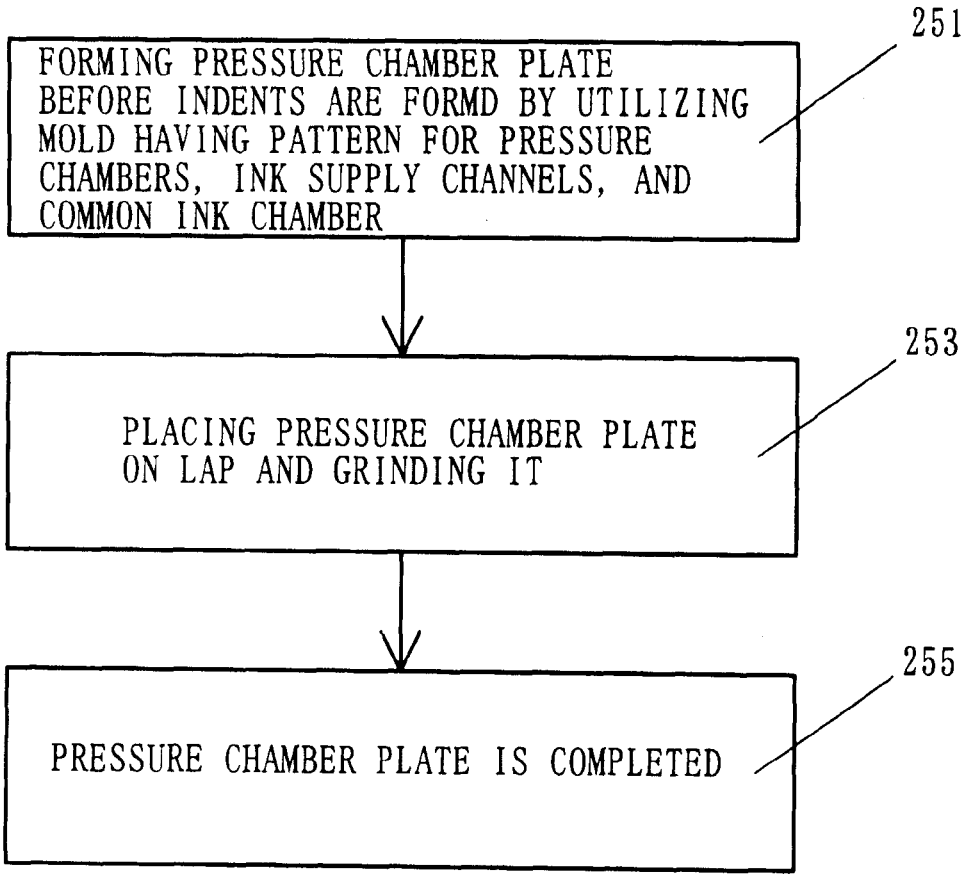
FIG. 14 is a flowchart for an exemplified method of manufacturing the pressure chamber plate shown in FIGS. 9 and 10.

Referring next to FIGS. 11 through 14, a description will be given of an exemplified grinding method for forming the indents 18A. FIG. 11 is a schematic sectional view for explaining a formation of the pressure chamber plate 10. FIG. 12 is a schematic sectional view for explaining a method of grinding the pressure chamber plate 10 shown in FIG. 11. FIG. 13 is a schematic sectional view of the completed pressure chamber plate 10. FIG. 14 is a flowchart for an exemplified grinding method for forming the indents 18A.

As shown in FIG. 11, the pressure chamber plate 10 is formed before the indents 18A is formed by an introduction of a glass material for the pressure chamber plate 10 into a mold 80 in which a pattern previously includes the pressure chambers 12, the ink supply channels 14 and the common ink chamber 16 (step 251). Next, this pressure chamber plate 10 is, as shown in FIG. 12, placed via its bottom surface 10*c* on a rotary table 83 in a surface plate 82 (step 253). The surface plate 82 may include, for example, but not be limited to, an automated precise mirror-finish lapping machine "Hyprez" manufactured by Engis Japan K.K. Slurry, e.g., diamond slurry is sprayed on the rotary table 83 by a slurry spray 86. The pressure chamber plate 10, to which a predetermined pressure is applied against the surface plate 82 by a weight 84, may be fixed or movable relative to the rotary table 83. Nevertheless, so far as a predetermined pressure is applied from the pressure chamber plate 10 to the surface plate 82, it is needless to say that the weight 84 is necessarily required. By using this, the bottom surface 1O*c* of the pressure chamber plate 10 is ground, and consequently, the pressure chamber plate 10 is completed, as shown in FIG. 13 (step 255).

In the present embodiment, the pressure chamber plate 10 is placed on the rotary table 83 so that the longitudinal direction of the pressure chamber 12 may be aligned with the diameter direction of the rotary table 83. It may readily be understood by this placement that the indents 18A are formed along each length of the pressure chambers 12 and the ink supply channels 14. It is however to be noted that shapes of the cross sections of the indents 18A are not necessarily a series of complete isosceles triangles as shown in FIGS. 9 and 10, in other words, the shapes of the indents shown in FIGS. 9 and 10 are illustration purposes only. The depth, roughness, and shape, etc. of the indents 18A can be controlled by the material and/or particle diameter of the slurry, a weight value of the weight 84, and a grinding time. An average roughness Ra is adjusted at ±3 $\mu$m in the present embodiment.

It may readily be understood that the bottom surface 10*c* of the pressure chamber plate 10 is ground using a sandblast, etc. as an alternative to the above described grinding method. As discussed above, however, the adjacent pressure chambers 12 or ink supply channels 14 preferably keep unconnected with each other by the indents 18; therefore it is preferable to sandblast the bottom surface 10*c* along the length of the pressure chambers 12.

Figure 15:
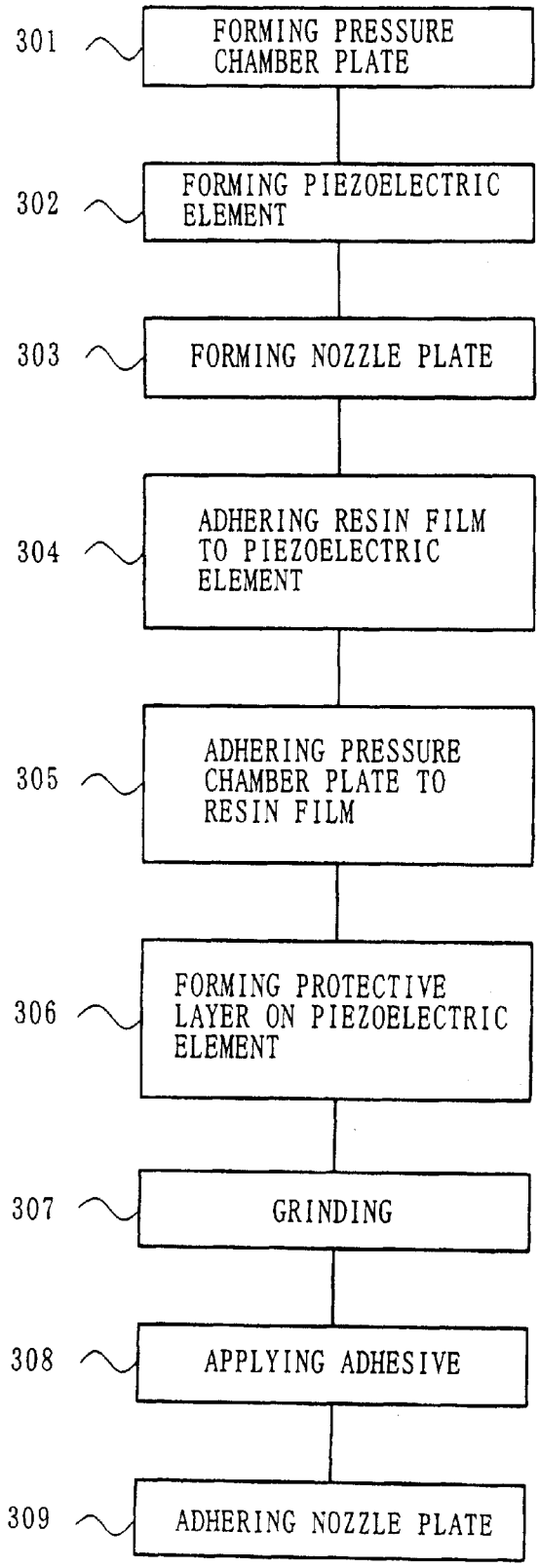
FIG. 15 is a flowchart for an exemplified method of manufacturing the inkjet head shown in FIG. 1.
Figure 16:
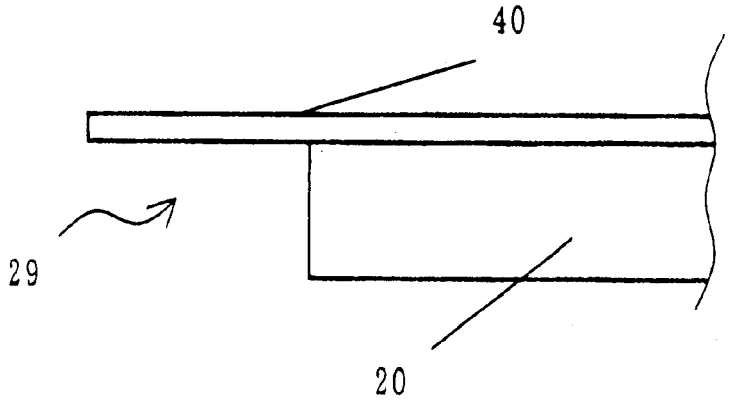
FIG. 16 is a schematic sectional view for explaining a step of the manufacturing method shown in FIG. 15.
Figure 17:
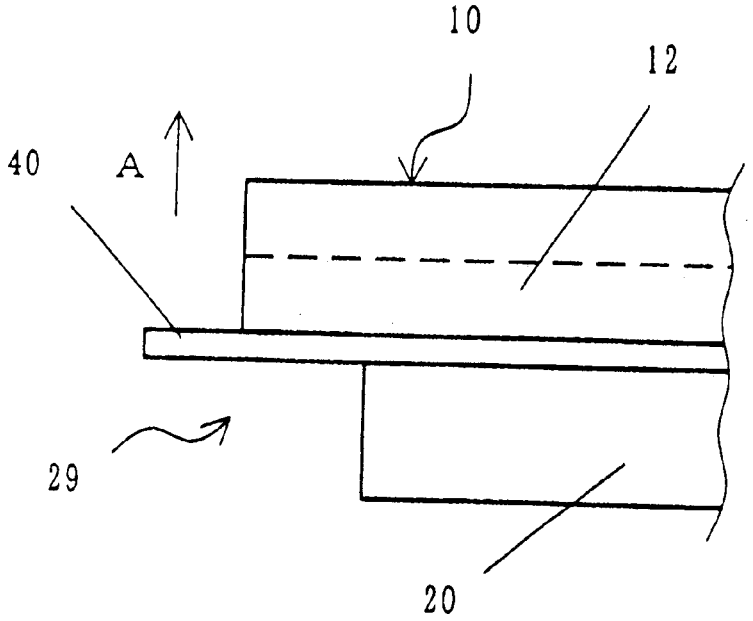
FIG. 17 is a schematic sectional view for explaining another step of the manufacturing method shown in FIG. 15.

Referring next to FIGS. 1, 15 through 18, a description will be given of a method of manufacturing the inkjet head 100 according to the present invention. FIG. 15 is a flowchart for an exemplified method of manufacturing the inkjet head 100 of the present invention. FIG. 16 is a schematic sectional view for explaining one step of the manufacturing method shown in FIG. 15; FIG. 17 is a schematic sectional view for explaining another step of the manufacturing method shown in FIG. 15. First, using any one of the foregoing methods or, further, an alternative method, the pressure chamber plate 10 is formed, which has the indents 18, the pressure chambers 12, the ink supply channels 14, and the common ink chamber 16 (step 301).

Subsequently, the piezoelectric element 20 is formed (step 302). This step 302 may be performed prior or parallel to the step 301. In the step 302, multiple green sheets are prepared first. Each green sheet is formed by mixing ceramic powder with a solvent, kneading them into a paste, and forming a thin film of about 50 $\mu$m in thickness by using a doctor blade. Among these green sheets, a pattern of the internal electrode 22 is formed and printed on one surface of each of three green sheets, while a pattern of the internal electrode 24 is formed and printed on one surface of each of the other three green sheets. No internal electrode is printed on the remaining sheets. The internal electrodes 22 and 24 are printed and patterned by the processes of mixing powder of metal alloy of silver and palladium with a solvent into a paste, and applying the paste to the sheets. Next, the three sheets with the internal electrode 22 printed thereon are alternately adhered to the three sheets with the internal electrode 24 printed thereon, and then they are adhered to the remaining six sheets. Thereby, the layered piezoelectric element 20 is formed. Those lower green sheets which include no internal electrode become a fundamental part in the piezoelectric element 20.

Firstly, these green sheets are sintered in a layered state. Secondly, part of the green sheets, at least the first six sheets, are cut using a diamond cutter from a front surface 20*a* to a back surface 20*b* through at least the first six sheets. A plurality of the piezoelectric blocks 21 divided by the grooves 23 is thereby formed. Lastly, the external electrodes 26 and 28 are formed respectively on the front surface 20*a* and the back surface 20*b* by the vacuum evaporation. The grooves 23 may be formed prior to the sinter. The property of the piezoelectric elements 20 is inspected by applying a voltage to the external electrodes 26 and 28, and any defective product is eliminated.

Next, the nozzle plate 30 is made using metal, such as stainless steel (step 303). Each nozzle hole 32 is processed into a cone shape (or taper shape in section) using a punch with a pin, which preferably extends from the front surface 30*b* on the nozzle plate 30 to its back surface 30*b*. One of the reasons for adhering the nozzle plate 30 to the pressure chamber plate 10 rather than integrating the pressure chamber plate 10 with the nozzle plate 30 is to obtain such a cone-shaped nozzle hole 32. In the present embodiment, the nozzle hole 32 has about 80 μm in diameter at the back surface 30*a*, and about 25 to 35 μm in diameter at the front surface 30*b*. This step 303 may be performed prior or parallel to the steps 301 and 302.

Next as shown in FIG. 16, the resin film 40 is adhered to the piezoelectric element 20 that is confirmed to work properly so that the film 40 projects toward the nozzle plate 30 by about 500 μm (step 304). This arrangement attempts to form a step 29 to subsequently apply the protective layer 50 to protect the piezoelectric element 20.

Next, as shown in FIG. 17, the pressure chamber plate 10 is adhered to the resin film 40 at the side opposite to the piezoelectric element 20 so that the plate 10 may recess toward the nozzle plate 30 relative to the resin film 40 by about 300 μm and project toward the nozzle plate 30 relative to the piezoelectric element 40 by about 200 μm (step 305). Before the pressure chamber plate 10 is adhered to the resin film 40, a positional adjustment is made so that each piezoelectric block 21 may correspond to each pressure chamber 12. In this embodiment, the adhesion between the piezoelectric element 20 and the resin film 40 precedes the adhesion between the resin film 40 and the pressure chamber plate 10. However, it is apparent that the present invention is to include the embodiment in which the step 305 precedes the step 304.

In the step 305, as described above, the adhesives 70 drain into the indents 18, whereby the overflows 70*a* occupy the pressure chambers 12 and the ink supply channels 14 to a lesser extent compared with such a case that the pressure chamber plate has no indent 18. On the other hand, the adhesive layer 70 after joining the elements can prevent an ink leakage from the pressure chambers 12, ink supply channels 14, and a common ink chamber 16, and steadfastly joins each element, thereby providing a stable structure of the inkjet head 100.

In the present embodiment, the pressure chamber plate 10 is so placed as to be recessed toward the nozzle plate 30 relative to the resin film 40. As will be discussed later, this is to prevent the protective layer 50 possible from intruding through the opening 12*a* into the pressure chambers 12 and from narrowing the openings 12*a* of the pressure chambers is, when the protective layer 50 is attempted to be applied to the step 29. However, the present invention may prevent the protective layer 50 from intruding into the pressure chambers 12 by placing an appropriate mask (especially, on the surface opposite to the resin film 40) on the pressure chamber plate 10 projecting from the resin film 40 before applying the protective layer 50. Therefore, in this case, the pressure chamber plate 10 may project toward the nozzle plate 30 relative to the resin film 40. In addition, the pressure chamber plate 10 is so placed as to project toward the nozzle plate 30 from the piezoelectric element 20. This is to prevent the piezoelectric element 20 from being ground in the grinding step as will be discussed later.

In forming the three-layer body shown in FIG. 17 including the pressure chamber plate 10, the resin film 40, and the piezoelectric element 20, turning the direction A in the gravity's direction would make the formation easier. Since the resin film 40 is projecting three layers in FIG. 17, it is expected to bend toward the pressure chamber plate. 10 by gravity, but the three-layer structure shown in FIG. 17 can be maintained by using a surface tension of the resin film 40. It is however needless to say that the direction A is not necessarily required to conform to the gravity's direction.

Next, the protective layer 50 is formed on the step 29 between the resin film 40 and the piezoelectric element 20 (step 306). Since a thermosetting epoxy adhesive is used for the protective layer 50 in this embodiment, the protective layer 50 is applied, and then thermally cured. Since the protective layer 50 is comparatively low in viscosity, when being applied to the step 29, it may partially intrude into the piezoelectric element 20 through its grooves 23. The protective layer 50, when thermally cured, is cured in such a state as to seal part of the grooves 23. The step 306 and the step 305 can be replaced with each other; the pressure chamber plate 10 can be adhered after the protective layer 50 is applied.

Next, the edge portions of the pressure chamber plate 10, the resin film 40, and the protective layer 50 are ground to form a flat nozzle joint surface 60 (step 307). This grinding step is necessary to allow the nozzles 32 of the nozzle plate 30 to precisely connect with the pressure chamber 12, and to firmly fix the nozzle plate 30 to the pressure chamber plate 10 and other element. When the grinding is completed, the protective layer is applied to the nozzle joint surface 60 by the thickness of approximately 20 through 50 μm (step 308), and the nozzle plate 30 is jointed onto the nozzle joint surface 60 in such a manner that each nozzle hole 32 corresponds to the pressure chamber 12 (step 309). Since the indents 18 maintain the flatness of the pressure chamber plate 10, each nozzle hole 32 can be arranged around the midsection in the opening 12*a* of the pressure chamber 12.

Figure 18:
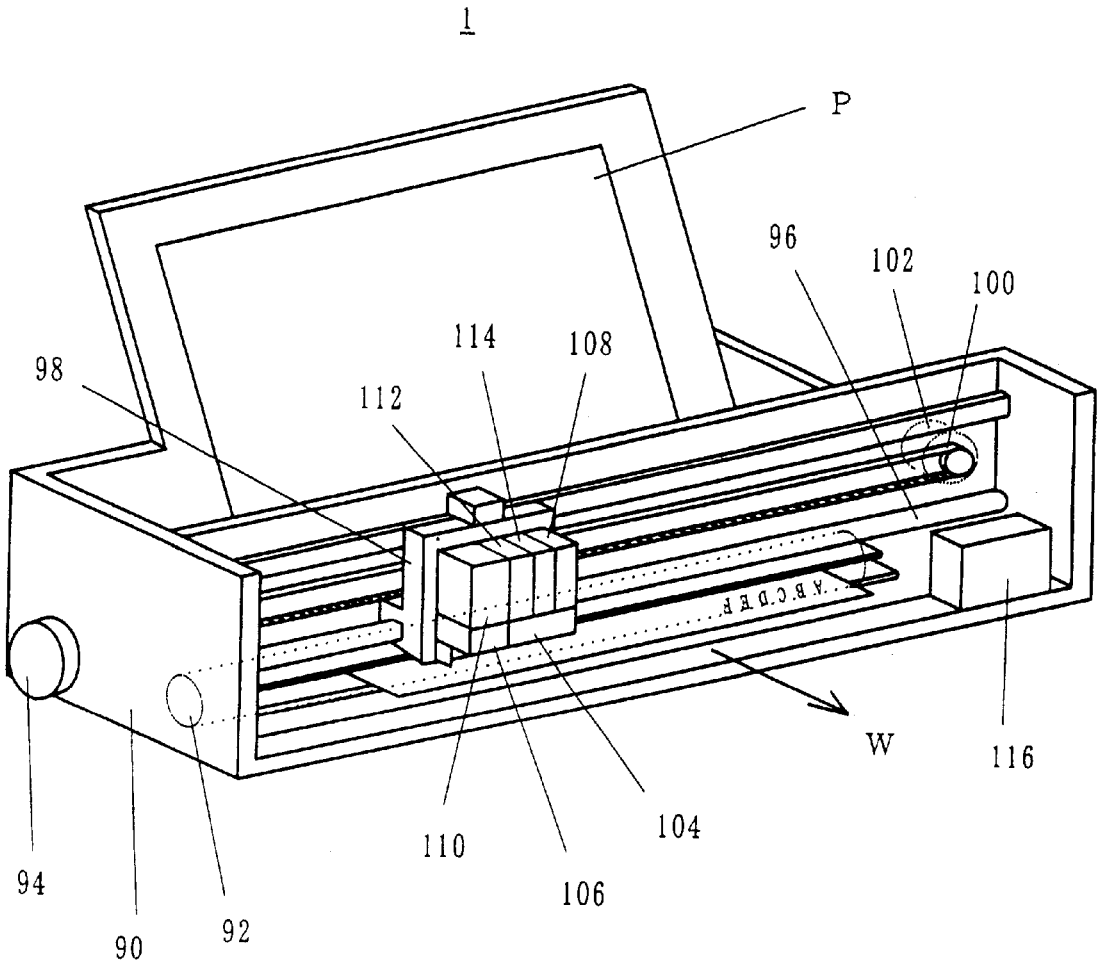
FIG. 18 is a schematic general perspective view of an inkjet printer to which the inkjet head shown in FIG. 1 is applicable.

A description will next be given of a color inkjet printer (recording device) 1 to which the inkjet head 100 shown in FIG. 1 can be applied, with reference to FIG. 18. FIG. 18 is a schematic perspective overview of the recording device 1.

The recording device 1 has a housing 110 in which a platen 112 is rotatably provided. In a recording operation, the platen 112 is driven and intermittently rotated by a drive motor 114, whereby printing paper P is fed intermittently at a predetermined pitch in an arrow direction W. The housing 110 of the recording device 1 also includes a guide rod 116 parallel to and above the platen 112, and a carriage 118 is slidably attached to this guide rod 116.

The carriage 118 is attached to an endless drive belt 120, which is driven by drive motor 122, whereby the carriage 118 reciprocates (scans) along the platen 112. The carriage 118 is mounted with a recording head 124 for a black color and a recording head 126 for multiple colors. The recording head 126 for multiple colors may be comprised of three parts. The recording head 124 for a black color is detachably mounted with a black ink cartridge 128, while the recording head 126 for multiple colors is detachably mounted with color ink cartridges 130, 132, and 134.

The black ink cartridge 128 stores black ink, whereas the color ink cartridges 130, 132 and 134 respectively store yellow ink, cyan ink and magenta ink. The cartridges have, at the bottom surface, holes (ink supply portions, not shown) connected with the corresponding heads, and each cartridge includes a sponge soaked with ink or an aluminum package storing ink. While the carriage 118 reciprocates along the platen 112, the recording head 124 for a black color and the recording heads 126 for multiple colors are driven based upon image data obtained from a wordprocessor, a personal computer, etc., thereby recording given characters, images, etc. on a printing paper P. When the recording operation ends, the carriage 18 returns to a home position, where a nozzle maintenance mechanism (backup unit) 136 is provided.

The nozzle maintenance mechanism 136 includes a movable suction cap (not shown) and a suction pump (not shown) connected to this movable suction cap. When the recording heads 124 and 126 are positioned at the home position, the suction cap becomes adhered to the nozzle plate in each recording head, and nozzles on the nozzle plate are suctioned by driving the suction pump, thus preventing any nozzle clogs.

In relation to the foregoing descriptions, the following embodiments are additionally disclosed hereupon. An inkjet head of one aspect of the present invention comprises a pressure chamber plate including a pressure chamber which stores ink, an elastic element connected with the pressure chamber plate, a piezoelectric element that may pressurize the pressure chamber in the pressure chamber plate through the elastic element, and an adhesive that adheres the elastic element and the pressure chamber plate to each other, wherein the pressure chamber plate includes an indent as a relief for the adhesive.

The pressure chamber plate may include a plurality of pressure chambers, and the indent is placed between the adjacent pressure chambers. The indent may be spaced from at least one of the adjacent pressure chambers. The pressure chamber plate may include a plurality of the pressure chambers, a plurality of ink supply channels that may supply the ink to the pressure chambers, and the indent placed between the adjacent ink supply channels. The above indent may be spaced from at least one of the adjacent ink supply channels. The above pressure chamber plate may include as the indent an average roughness of ±2 $\mu$m or more at a connection surface that is connectable to the elastic element.

An inkjet head of another aspect of the present invention comprises a pressure chamber plate forming a pressure chamber which stores ink, an auxiliary element connected with the pressure chamber plate, a pressurizing element that may jet the ink in the pressure chamber by pressurizing the pressure chamber, and an adhesive that adheres the auxiliary element and the pressure chamber plate to each other, wherein said pressure chamber plate includes an indent as a relief for said adhesive.

A recording device of still another aspect of the present invention comprises an inkjet head, and a driving device that drives the inkjet head, wherein the inkjet head comprises a pressure chamber plate forming a pressure chamber which stores ink, an auxiliary element connected with the pressure chamber plate, a pressurizing element that may jet the ink in the pressure chamber by pressurizing the pressure chamber, and an adhesive that adheres the auxiliary element and the pressure chamber plate to each other, wherein the pressure chamber plate includes an indent as a relief for the adhesive.

A method of manufacturing an inkjet head as an exemplified embodiment of the present invention comprises the steps of forming an indent in a pressure chamber plate that includes a pressure chamber that may store ink, connecting an elastic element with the pressure chamber plate via an adhesive while permitting the adhesive to drain into the indent, and connecting with the elastic element a piezoelectric element that can pressurize the pressure chamber in the pressure chamber plate through the elastic element.

The forming step may form the indent by means of molding using a mold having a pattern of the indent. The forming step may form the indent by grinding the pressure chamber plate. The forming step may includes the steps of forming a pattern corresponding to the indent, and etching the pattern.

When the pressure chamber plate and the piezoelectric element plate are being joined together via a film material, an adhesive pours into the indent in the pressure chamber plate, reducing an overflow compared with the inkjet head to which the present invention is not applied for. This prevents the pressure chamber and ink supply channel from reducing their volumes and/or clogging. This also serves to eliminate the uneven thickness of the adhesive layer.

Furthermore, the sizes of the ink supply channel and the pressure chamber may become approximately in accordance with designed values, improving the ink jetting characteristic and variations among nozzles. An increased surface area of the joint surface and an anchor effect improve its joint strength.

The foregoing effects serve to realize an inkjet head that can inexpensively print high-quality images using a simple structure and produces less trouble.

What is claimed is:

1. An inkjet head comprising:

a pressure chamber plate including a pressure chamber which stores ink;

an elastic element connected with said pressure chamber plate;

a piezoelectric element that may pressurize said pressure chamber in said pressure chamber plate through said elastic element; and an adhesive that adheres said elastic element and said pressure chamber plate to each other, wherein said pressure chamber plate includes an indent as a relief for said adhesive.

2. An inkjet head according to claim 1, wherein said pressure chamber plate includes a plurality of pressure chambers, and includes the indent between the adjacent pressure chambers.

3. An inkjet head according to claim 2, wherein the indent may be spaced from at least one of the adjacent pressure chambers.

4. An inkjet head according to claim 1, wherein the pressure chamber plate includes a plurality of pressure chambers, a plurality of ink supply channels that may supply the ink to the pressure chambers, and the indent between the adjacent ink supply channels.

5. An inkjet head according to claim 4, wherein the indent is spaced from at least one of the adjacent ink supply channels.

6. An inkjet head according to claim 1, wherein the pressure chamber plate may include as the indent an average roughness of ±2 $\mu$m or more at a connection surface connectable to said elastic element.

7. An inkjet head comprising:

a pressure chamber plate forming a pressure chamber which stores ink;

an auxiliary element connected with said pressure chamber plate;

a pressurizing element that may jet said ink in said pressure chamber by pressurizing said pressure chamber; and an adhesive that adheres said auxiliary element and said pressure chamber plate to each other, wherein said pressure chamber plate includes an indent as a relief for said adhesive.

8. A recording device comprising:

an inkjet head; and a driving device that drives said inkjet head, wherein said inkjet head comprises:

a pressure chamber plate forming a pressure chamber which stores ink;

an auxiliary element connected with said pressure chamber plate;

a pressurizing element that may jet said ink in said pressure chamber by pressurizing said pressure chamber; and an adhesive that adheres said auxiliary element and said pressure chamber plate to each other, wherein said pressure chamber plate includes an indent as a relief for said adhesive.

9. A method for manufacturing an inkjet head comprising the steps of:

forming an indent in a pressure chamber plate that includes a pressure chamber that may store ink;

connecting an elastic element with said pressure chamber plate via an adhesive while permitting said adhesive to drain into said indent; and connecting with said elastic element a piezoelectric element that can pressurize said pressure chamber in said pressure chamber plate through said elastic element.

10. A method according to claim 9, wherein said forming step forms the indent by means of molding using a mold having a pattern of the indent.

11. A method according to claim 9, wherein said forming step forms the indent by abrading the pressure chamber plate.

12. A method according to claim 9, wherein said forming step includes the steps of:

forming a pattern corresponding to the indent; and etching the pattern.

* * * * *